US005961407A

United States Patent [19]

Spiegel

[11] Patent Number: 5,961,407

[45] **Date of Patent: *Oct. 5, 1999**

[54] FOOTBALL WITH ODD NUMBER OF PANELS

[75] Inventor: H. Jay Spiegel, Mount Vernon, Va.

[73] Assignee: Premium Products, Inc., Mount Vernon, Va.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/007,360

[22] Filed: Jan. 15, 1998

Related U.S. Application Data

[63] Continuation of application No. 08/753,681, Nov. 27, 1996, Pat. No. 5,709,622.

[51] Int. Cl.[6] ..... A63B 41/08

[52] U.S. Cl. ..... 473/599; 473/607

[58] Field of Search ..... 473/569, 575, 473/595, 596, 597, 598, 599, 603, 607, 608, 610, 438

[56] References Cited

U.S. PATENT DOCUMENTS

| | | | |
|---|---|---|---|
| 1,505,802 | 8/1924 | Pierce | 473/603 |
| 1,518,448 | 12/1924 | Pierce | 473/599 |
| 3,425,693 | 2/1969 | Murray | 473/438 |
| 4,462,590 | 7/1984 | Mitchell | 473/603 |
| 4,531,737 | 7/1985 | Jacobson et al. | 473/597 |
| 5,098,097 | 3/1992 | Kennedy et al. | 473/599 |
| 5,133,550 | 7/1992 | Handy . | |
| 5,294,112 | 3/1994 | Smith | 473/610 |
| 5,342,043 | 8/1994 | Baltronis et al. | 473/599 |
| 5,470,060 | 11/1995 | Spiegel | 473/599 |
| 5,603,497 | 2/1997 | Louez . | |

FOREIGN PATENT DOCUMENTS

| | | | |
|---|---|---|---|
| 551010 | 3/1923 | France | 273/65 E |
| 9232 | 6/1888 | United Kingdom | 273/65 ED |
| 266507 | 3/1927 | United Kingdom | 273/65 E |

OTHER PUBLICATIONS

Copy of Facsimile sent to Applicant by Pro Football Hall of Fame forwarding Historical Materials concerning the Evolution of the American Football, 1997.

*Primary Examiner*—Steven Wong
*Attorney, Agent, or Firm*—H. Jay Spiegel

[57] ABSTRACT

A football is made in "regulation" size and shape for high school, college and professional football or generally proportional thereto. However, instead of having four panels and four seams as is conventionally the case, an odd number of panels and seams, for example, five panels and seams is provided. When kicking an oblate spheroidal football, the place kicker normally kicks the football at a location diametrically opposite to the location of the laces of the football. By providing an odd number of panels, the disclosed football is preferably kicked at a location where no seam is located thereby enhancing the effectiveness and accuracy of kicking. If desired, the panel opposed to the laces is reinforced with an internal reinforcing panel which internally covers the entire panel. Alternatively, two reinforcing patches are provided, each of which is located at a "sweet spot" of the football. In either case, the weight of the reinforcement is preferably equalized to the weight of the laces so that the football remains balanced. Where the football has an odd number of panels greater than four, the cross-sections defined by the short circumference and by circumferences in parallel planes to the short circumference are closer to circular than is the case with a conventional four panel football, thereby resulting in reduced wind resistance and greater accuracy and distance when thrown or punted in a spiral as compared to a conventional four panel football. Where the football is made of at least five panels, when the quarterback grips the laces with his fingers, the thumb may reach and engage the second seam away from the laces to provide an enhanced grip.

11 Claims, 3 Drawing Sheets

FOOTBALL WITH ODD NUMBER OF PANELS

This application is a Continuation of Application Ser. No. 08/753,681, filed on Nov. 27, 1996 now U.S. Pat. No. 5,709,622. Reference is made to Applicant's prior U.S. Pat. No. 5,470,060, issued Nov. 28, 1996, the disclosure and prosecution history of which are incorporated, by reference, herein, including all cited and applied references.

BACKGROUND OF THE INVENTION

In the game of American football, the football which is employed is known as an oblate spheroidal ball. Those American footballs which are known are constructed of four panels sewn together at four seams, with one of the seams having an opening for insertion of the inflatable bladder, which opening is thereafter closed through the use of laces which are also gripped when the football is thrown. American footballs have dimensions permitting them to be thrown in a "spiral", place kicked end over end and punted end over end or in a "spiral".

As is known, the preferred location to place kick such a football is diametrically opposite to the seam on which the laces are located. Under such circumstances, with four panels and four seams, this kicking location is located on a seam diametrically opposite to the seam which carries the laces. Thus, the location where the football is commonly kicked is a surface including the described seam as well as the adjacent surfaces of the panels which are interconnected at that seam. Thus, the striking surface of the place kicker's shoe engages a surface of the football that is non-uniform, that is, from left to right, includes a panel surface, a seam and a panel surface. As a football is used and exhibits wear, and under adverse weather conditions such as those including rain and snow, the wear patterns on the surface of a football are non-uniform. In particular, footballs appear to wear more prominently on the panels thereof as compared to within the seams thereof. This inconsistency of wear adds to potential inconsistency in effectiveness of place kicking. Thus, it would be advantageous to place kick a football on a uniform surface thereof to thereby provide uniformity of trajectory and distance.

Unfortunately, as American footballs are now manufactured, in order to kick such a football on a uniform surface such as that which is located on a panel remote from a seam, one would have to rotate the football on its tip to a position where the laces are misaligned from the direction of force application from the foot. Under such circumstances, the resultant weight imbalance caused by this misalignment of the laces will necessarily affect the trajectory of the kicked ball, causing it to arc in the direction corresponding to the lateral location of the laces. As such, a need has developed for a football which may be place kicked in an effective manner with the laces aligned with the direction of force application of the place kicker's foot. It is with this need in mind that the present invention was developed.

Applicant is aware of U.S. Pat. No. 4,531,737 to Jacobson et al. Jacobson et al. teach an elongated "football" specifically designed to be easily grasped and thrown by the user and which includes three separately inflatable internal bladders. Jacobson et al. teach the use of five panels sewn together with five seams, however, each seam is disclosed as carrying laces or simulated laces. There is no teaching or suggestion by Jacobson et al. that the disclosed "elongated football" is intended to be used in playing the game of American football nor do Jacobson et al. teach the ability to kick their device. Clearly, the elongated "football" of Jacobson et al. may not be effectively place kicked due to its elongated dimensions and the inherent lack of stability that would result. The elongation would prevent the "ball" from maintaining an end over end flight pattern. According to the rules of the National Football League, an American football must be 11 to 11½ inches in length, have a long circumference of 28 to 28½ inches and a short circumference of 21 to 21¼ inches (corresponding to a maximum diameter of 6.68" to 6.76") and must weigh between 14 and 15 ounces. These dimensions are nowhere contemplated by the Jacobson et al. device that is disclosed as having a length of "more than two feet" and a maximum diameter of "no more than about ten inches".

Applicant is also aware of U.S. Pat. No. 1,505,802 to Pierce which discloses a football having an inflation stem as well as a patch on the other side of the ball designed to balance the weight of the inflation tube. Pierce also contemplates the use of a second filling tube in conjunction with the patch as a balancing means. While Pierce does teach the concept of balancing the weight of the filling tube, Pierce fails to teach balancing the weight of the laces of the football nor the other aspects of the present invention including the use of an odd number of panels and reinforcement of a single panel diametrically opposite to the laces of the ball.

SUMMARY OF THE INVENTION

The present invention relates to embodiments of an improved football with odd number of panels. The present invention includes the following interrelated objects, aspects and features:

(A) In a first aspect, the present invention consists of an oblate spheroidal football generally having the dimensions proportional to those that are approved for use in American pee wee and junior football leagues, high schools, colleges and in the National Football League. The National Football League requires a football to have a length of 11 to 11½ inches, with a long circumference traversing the tips of the football being 28 to 28½ inches, and with a short circumference midway between the tips of the football and traversing the laces of the football being from 21 to 21¼ inches corresponding to a maximum diameter of 6.68 to 6.76 inches. Such a football must weigh from 14 to 15 ounces. American high school and college footballs are similarly sized. It is contemplated that the present invention will fall approximately within these required dimensions with a short circumference of about 21 to 22 inches corresponding to a maximum diameter of about 6.68 to 7 inches, a length of about 11 to 12 inches and a long circumference of about 28 to 29 inches.

(B) The usual American football is an oblate spheroidal ball having four panels interconnected with four respective interconnecting seams. One of the seams has an opening for insertion of an inflatable bladder, which opening is closed by a series of laces which also serve the purpose of being gripped when the football is thrown.

(C) The present invention improves upon the traditional American football in a manner resulting in enhanced performance of the football when thrown or kicked. In the preferred embodiment, the football is provided with an odd number of substantially identical panels interconnected with respective seams, odd in number. In the preferred embodiment, as illustrated in the drawing figures, five panels are interconnected together through the use of five respective seams. In this way, the panel diametrically opposite to the seam carrying the laces includes a region thereon directly diametrically opposite to the seam carrying the laces that is devoid of a seam. This region includes two "sweet spots" that, when one of them is kicked, provide optimal trajectory and distance of the kicked football. Inconsistencies in kicking that result when the seam opposite the laces in a conventional football is kicked are necessarily eliminated.

(D) If desired, the panel, described above, which is to be kicked, that is located diametrically opposite the laces of the ball may be reinforced to enhance transfer of force to the football from the place kicker's foot. In one embodiment, this reinforcement consists of an entire reinforcing panel affixed to the outer panel on its inner surface, preferably through glueing as well as sewing at the internal portions of the seams. In a second embodiment, two small patch-like reinforcements are affixed to the internal surfaces of the panel at locations surrounding and encompassing the respective "sweet spots" of the football to enhance force transfer at those specific locations. In either embodiment, the reinforcing means is provided with a weight that matches the weight of the laces. In this way, the reinforcing means balances the weight of the laces to provide a football that is better balanced than prior art footballs.

(E) The football defines an inner chamber preferably filled with a single bladder having a single inflation valve and valve stem.

(F) As is known, a football is made of flat pieces of leather cut into panel shapes and sewn together, with the panels adopting a curved configuration when a football-shaped bladder within the panels is inflated. Where the odd number of panels employed in the present invention is greater than the four panels employed in known footballs, for example, five panels, the cross-sections defined by the short circumference of the ball and by circumferences in parallel planes thereto are slightly closer to circular than is the case with a four panel ball. As a result, when such a football is thrown or punted in a spiral, wind resistance is reduced as the football spins thereby increasing accuracy and distance as compared to performance of a four panel football of equal long circumference, short circumference, length and weight.

(G) Where the inventive football is made of an odd number of panels comprising at least five panels, when a quarterback grips the laces with his fingers, the thumb may reach and engage the second seam away from the laces to provide an advantageously enhanced grip.

Accordingly, it is a first object of the present invention to provide an improved football with odd number of panels.

It is a further object of the present invention to provide such a football wherein, in the preferred embodiment thereof, five panels are provided.

It is a yet further object of the present invention to provide such a football wherein that panel diametrically opposite to the football laces may be reinforced through the use of reinforcing means.

It is a still further object of the present invention to provide the reinforcing means as a reinforcement completely covering the internal surfaces of the panel opposite the football laces.

It is a yet further object of the present invention to provide the reinforcing means as two patch-like reinforcements located on the internal surfaces of the panel diametrically opposite to the laces and located at the "sweet spots" of the football.

It is a yet further object of the present invention to make the reinforcing means of a particular weight designed to balance the weight of the laces.

These and other objects, aspects and features of the present invention will be better understood from the following detailed description of the preferred embodiments when read in conjunction with the appended drawing Figures.

SPECIFIC DESCRIPTION OF THE PREFERRED EMBODIMENTS

Figure 1:
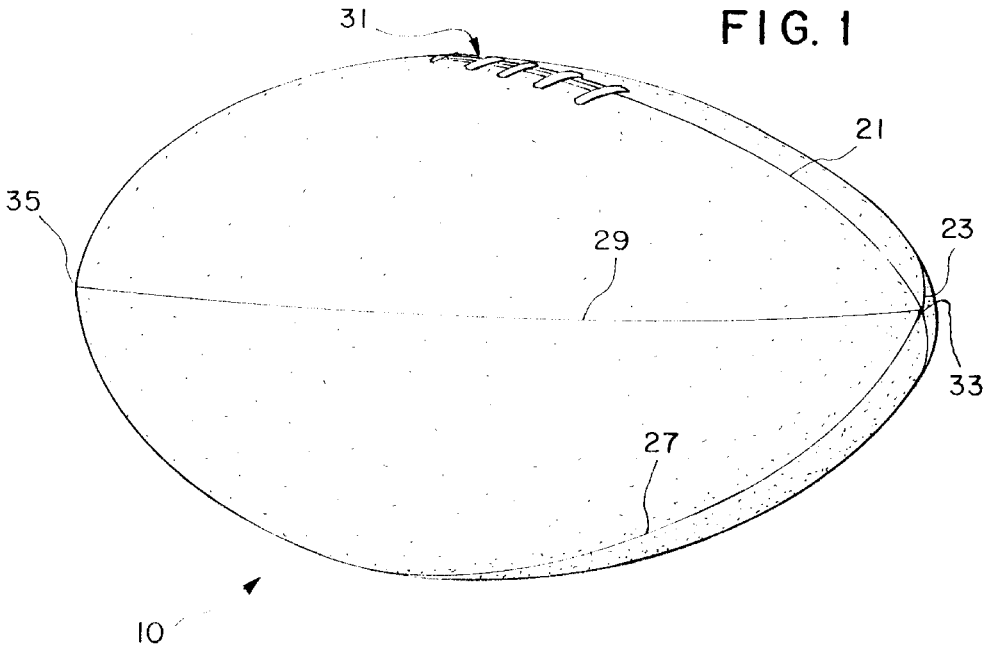
FIG. 1 shows a side perspective view of the present invention.
Figure 2:
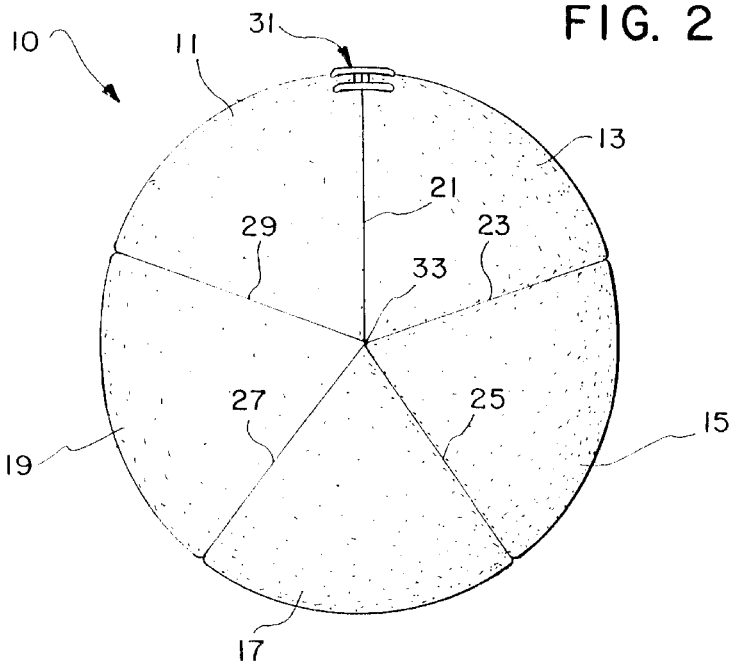
FIG. 2 shows an end view of the present invention.
Figure 3:
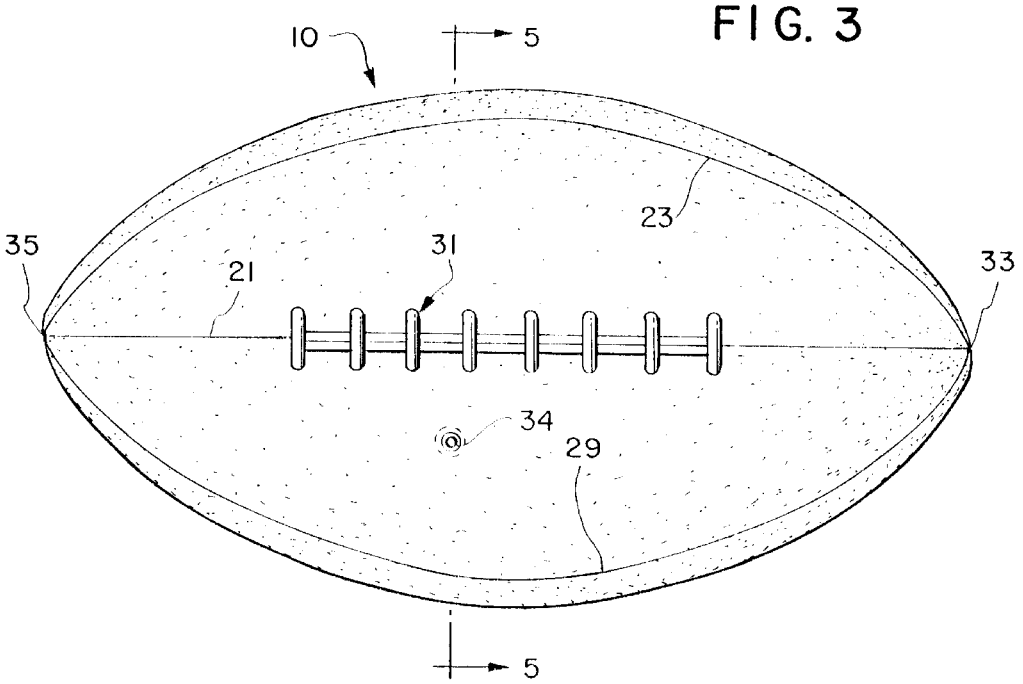
FIG. 3 shows a top view looking down on the laces of the present invention.

With reference, first, to FIGS. 1–3, the inventive football is generally designated by the reference numeral 10 and is seen to include panels 11, 13, 15, 17 and 19.

The panels 11 and 13 are interconnected together at a seam 21. The panels 13 and 15 are interconnected together at a seam 23. The panels 15 and 17 are interconnected together at a seam 25. The panels 17 and 19 are interconnected together at a seam 27. Finally, the panels 19 and 11 are interconnected together at a seam 29. As will be better understood from FIGS. 4 and 5, each of the seams consists of a turned-in portion of each adjacent panel with these turned-in portions abutting one another within the football and being sewn together, as is conventional. As also seen in FIGS. 1, 2 and 3, the seam 21 carries laces 31 that close an opening (not shown) that allows insertion of an inflatable bladder 32 having an inflation valve 34. The laces 31, the opening (not shown) and the inflatable bladder 32 are conventional as is well known by those skilled in the art.

As seen, in particular, in FIGS. 1–3, the respective seams converge at two diametrically opposed ends of the football 10 at the tips 33 and 35. Each panel has opposed narrowed ends and sides extending between the ends. The sides diverge away from one another, then converge toward one another in a direction from one end to another end. Each end of each panel forms a portion of one of the tips.

As seen in the drawings, particularly FIGS. 1–3, the inventive football has five panels interconnected by five seams. As should be understood, the present invention contemplates an American football made having an odd number of panels interconnected by an odd number of respective seams. Thus, within the purview of the present invention, it is contemplated that such a football may be made using three, five, seven or even nine panels. However, there is an upper limit above which the advantages of the present invention would be overtaken by certain disadvantages. In this regard, each seam consists of a termination of each adjacent panel providing a double thickness sewn together to create the seam. As the number of panels increases, the number of locations of this double thickness increases around the circumference of the football and this accordingly increases the weight of the football. Thus, as the number of panels increases, it becomes more difficult to maintain suitable panel thickness while maintaining the football within the weight limitations of the National Football League, college, high school and pee wee football.

Figure 4:
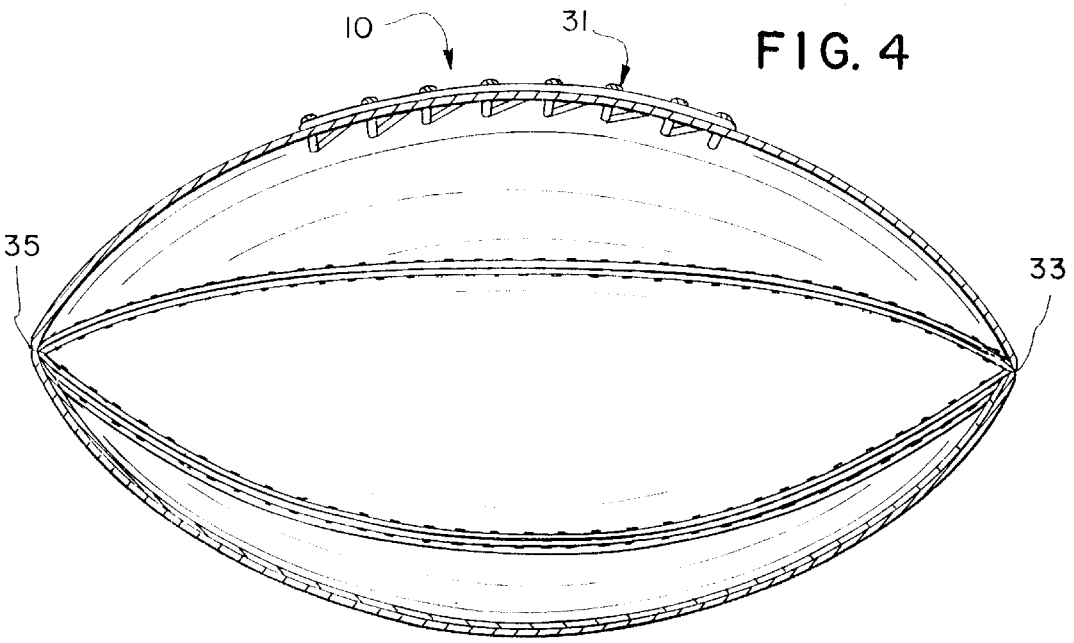
FIG. 4 shows a longitudinal cross-section along the line IV—IV of FIG. 3.
Figure 5:
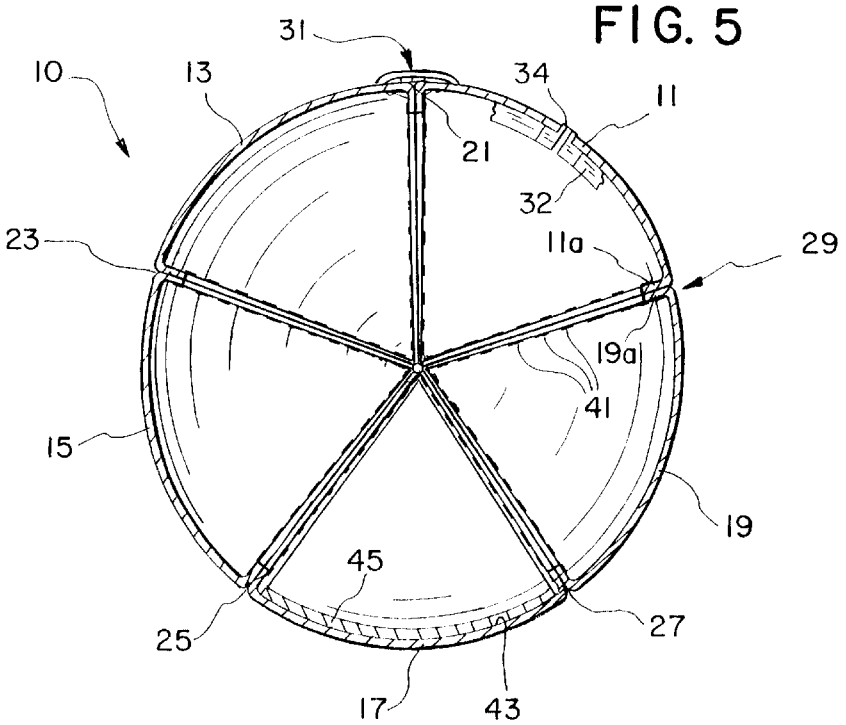
FIG. 5 shows a cross-section along the line 5—5 of FIG. 3.

With reference to FIGS. 4 and 5, FIG. 5 in particular, the internal structure of the seams is clearly shown. Thus, using the seam 29 for illustrative purposes, it is seen that the panel 11 has an edge 11*a* which is abutted against an edge 19*a* of the panel 19 with these edges being sewn together, with the stitching designated by the reference numeral 41 in FIG. 5.

With further reference to FIG. 5, it is seen that the panel 17 has an internal surface 43 to which reinforcing means may be affixed, consisting of an additional panel 45 that may be fastened to the inner surface 43 of the panel 17 by any suitable means such as, for example, adhesive. If desired, the periphery of the panel 45 may be sewn to the edges of the panel 17 at the seams 25 and 27. As clearly understood from FIG. 5, the reinforcing panel 45 is diametrically opposite the laces 31 of the football 10. In the preferred embodiment of the present invention, the weight of the panel 45 is selected to be substantially the same as the weight of the laces 31 thereby causing the football 10 to be substantially weight-balanced from one side to the other. While the football 10 is preferably made of a material such as leather, pigskin, rubber or plastic, depending upon the application, the reinforcing panel 45 may be made of any suitable material that provides reinforcement to the panel 17 to optimally transfer the forces generated by a place kicker's foot through the entire football 10 to cause the football 10 to be effectively propelled through the air. Where the football is made of rubber or plastic, the seams may be simulated to provide the appearance of seams. The panel 45 may be suitably made of plastic, leather, or reinforced materials such as those including carbon fiber, boron fiber, KEVLAR or any other suitable reinforcing materials.

Figure 6:
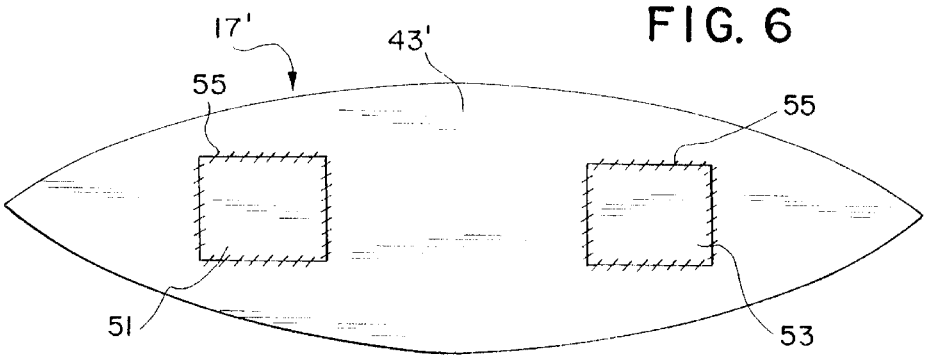
FIG. 6 shows a view of the inside surface of one of the panels of the present invention, in a modification.
Figure 7:
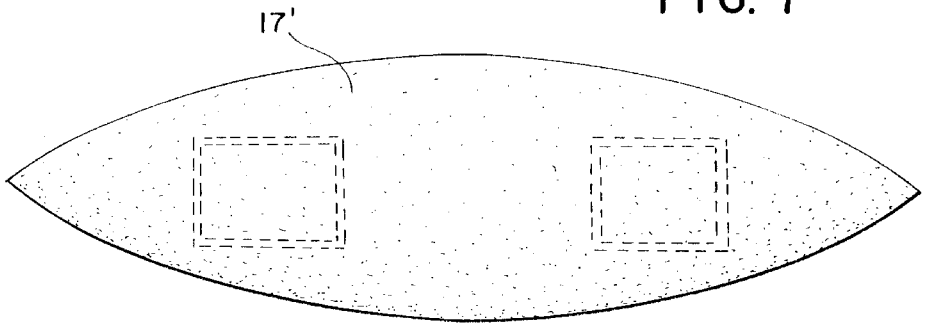
FIG. 7 shows a view of the outer surface of the panel illustrated in FIG. 6.

With reference to FIGS. 6 and 7, a panel 17' is shown that is intended to be located on the football 10 in the same location as the panel 17 as shown in FIGS. 1–5. The panel 17' is, itself, identical to the panel 17. However, instead of employing the reinforcement panel 45, the panel 17' includes two patch-like reinforcing panels 51 and 53 that are best seen in FIG. 6 as attached to the panel 17' through the use of stitching 55. As is known, an oblate spheroidal ball has two "sweet spots", depending upon which tip is facing the ground. When a football such as the football disclosed herein is kicked at one of the "sweet spots", the football will fly through the air end over end with enhanced trajectory, distance and stability. The patch-like reinforcing panels 51, 53 are designed to surround and encompass the "sweet spots" of the football so that when the football is kicked there, maximum transference of force to the entirety of the football will result. Of course, if desired, the panels 51, 53 may be affixed to the internal surface 43' of the panel 17' by any suitable means including through the use of any suitable adhesive. The materials from which the patch-like panels 51, 53 are made may be the same as the materials described hereinabove for the panel 45.

As such, an invention has been disclosed in terms of preferred embodiments thereof which fulfill each and every one of the objects of the invention as set forth hereinabove and provide a new and useful improved football with odd number of panels of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An oblate spheroidal football, comprising:

a) a body including an odd number of substantially identical panels connected together;

b) at least one seam or simulated seam interconnecting two adjacent panels and carrying at least one protrusion;

c) said football generally having dimensions of length, long circumference and short circumference of an American football proportional to those commonly used in official games played by pee wee and junior football leagues, high schools, colleges and professional teams.

2. The football of claim 1, wherein said odd number of panels comprises five panels.

3. The football of claim 1, wherein said at least one protrusion comprises at least one simulated lace.

4. The football of claim 3, wherein said at least one simulated lace comprises a plurality of simulated laces.

5. The football of claim 1, wherein said at least one protrusion comprises a lace.

6. An oblate spheroidal football, comprising:

a) a body including an odd number of panels connected together, said body having two opposed tips, each panel having opposed narrowed ends and sides extending between said ends, said sides diverging away from one another, then converging toward one another in a direction from one end to another end, each end of each panel forming a portion of one of said tips;

b) at least one seam or simulated seam interconnecting sides of two adjacent panels and carrying at least one protrusion;

c) said football generally having dimensions of length, long circumference and short circumference of an American football proportional to those commonly used in official games played by pee wee and junior football leagues, high schools, colleges and professional teams.

7. The football of claim 6, wherein said odd number of panels comprises five panels.

8. The football of claim 6, wherein said at least one protrusion comprises at least one simulated lace.

9. The football of claim 8, wherein said at least one simulated lace comprises a plurality of simulated laces.

10. The football of claim 6, wherein said at least one protrusion comprises a plurality of laces.

11. The football of claim 6, wherein said at least one protrusion comprises a lace.

* * * * *